US006935835B2

(12) United States Patent
Della Mora

(10) Patent No.: US 6,935,835 B2
(45) Date of Patent: Aug. 30, 2005

(54) ANTI-NOISE AND ANTI-VORTEX STABILIZER

(75) Inventor: Pierangelo Della Mora, Codroipo (IT)

(73) Assignee: Comefri S.p.A., Magnano in Riviera (IT)

( * ) Notice: Subject to any disclaimer, the term of this patent is extended or adjusted under 35 U.S.C. 154(b) by 0 days.

(21) Appl. No.: 10/245,094

(22) Filed: Sep. 17, 2002

(65) Prior Publication Data

US 2004/0005215 A1 Jan. 8, 2004

(30) Foreign Application Priority Data

Jul. 2, 2002 (IT) ..... VI2002A0145

(51) Int. Cl.[7] ..... F04D 29/66

(52) U.S. Cl. ..... 415/119; 415/206; 415/211.2; 415/158

(58) Field of Search ..... 415/119, 206, 415/211.2, 158, 148

(56) References Cited

U.S. PATENT DOCUMENTS

| | | | | |
|---|---|---|---|---|
| 2,015,210 A | | 9/1935 | Witzel | |
| 2,155,631 A | | 4/1939 | Anderson | |
| 2,171,341 A | | 8/1939 | McMahan | |
| 2,335,734 A | | 11/1943 | Caldwell | |
| 3,191,851 A | | 6/1965 | Wood | |
| 5,772,399 A | * | 6/1998 | Mehta et al. | 415/148 |

FOREIGN PATENT DOCUMENTS

| | | |
|---|---|---|
| EP | 0 342 484 | 11/1989 |
| EP | 0 928 899 | 7/1999 |
| GB | 479 823 | 2/1938 |

OTHER PUBLICATIONS

EPO Search Report.

* cited by examiner

*Primary Examiner*—Edward K. Look
*Assistant Examiner*—Kimya N. McCoy
(74) *Attorney, Agent, or Firm*—Hedman & Costigan, P.C.

(57) ABSTRACT

A centrifugal fan (10) with improved efficiency and decreased noise, comprising a fan housing (12), in the form of a fan housing, with parallel sides (22, 23), which are fixed to opposite edges of a casing scroll (24), and a fan or impeller (25) with blades (27), positioned inside the fan housing (12), in such as way that it does or does not overlap the end of a inlet cone (26); a flow sharing device element (20), shaped and produced in a single piece (20) or in more than one piece (28, 30), with at least one appendage facing the inlet cone (26), and if necessary overlapping the impeller (25) and extending for the width of the discharge opening (21), in such as way to allow homogenization of the flow delivered and reduction of vortices, which cause high noise and loss of efficiency of the centrifugal fan (10).

10 Claims, 11 Drawing Sheets

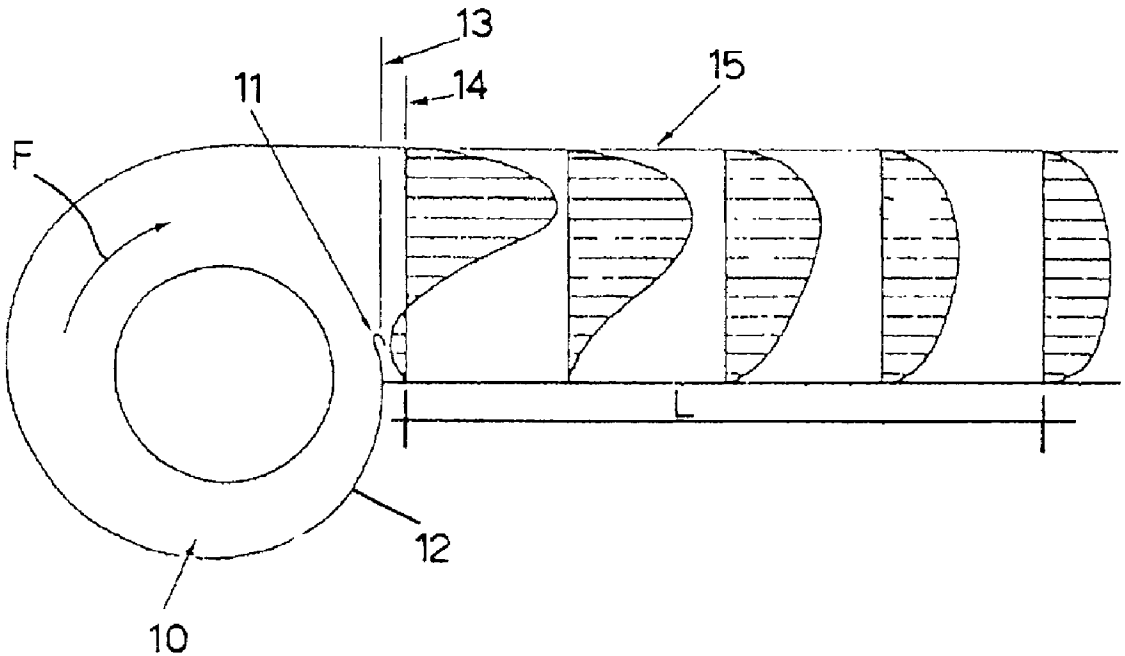
Fig.1
PRIORART

Fig.5C
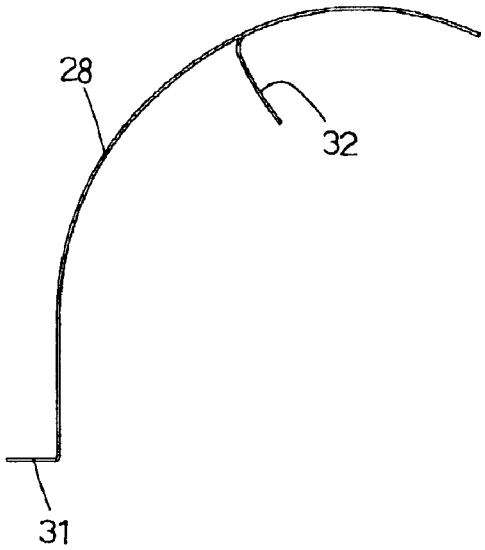
Fig.5B
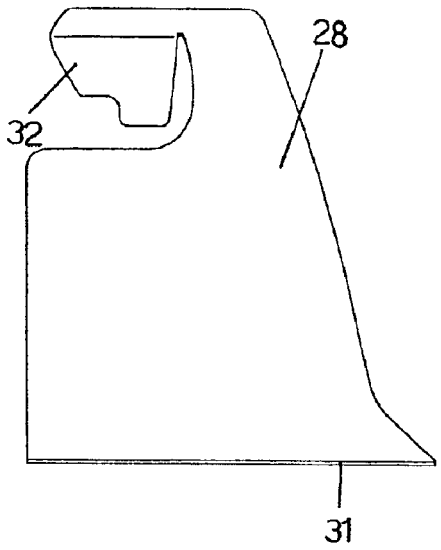
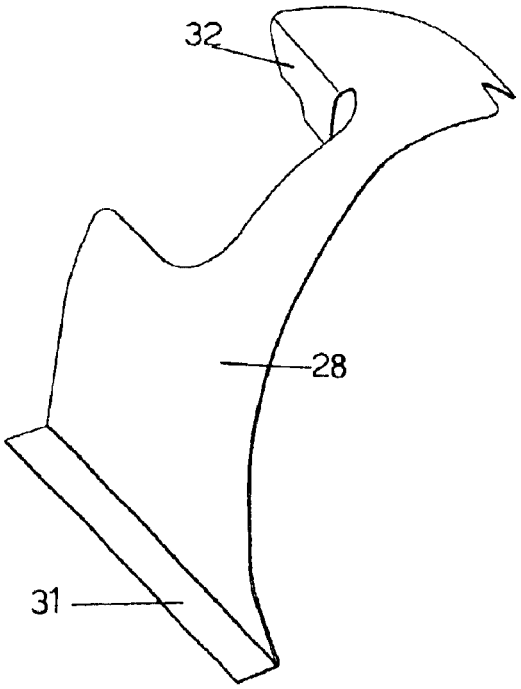
Fig.5A

Fig. 7C
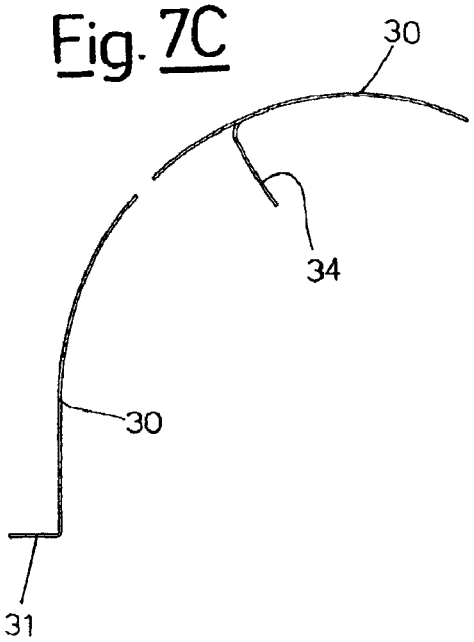
Fig. 7B
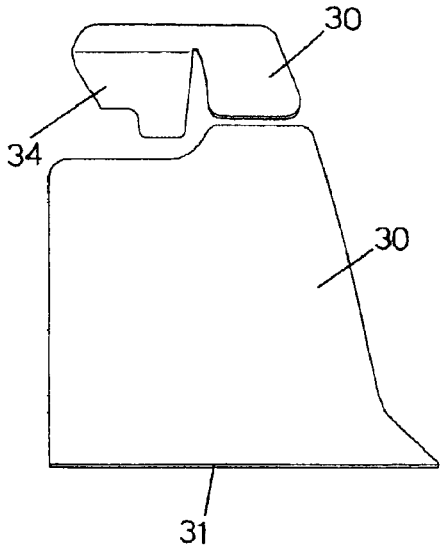
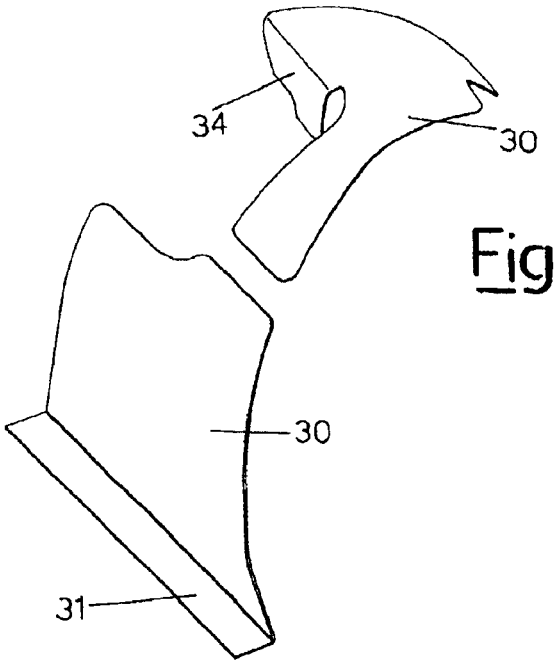
Fig. 7A 30
34

30
34

30
34

30
34

30
34

30
34

30
34

30
34

30
34

30
34

30
34

30
34

30
34

30
34

30

17
31
33

ANTI-NOISE AND ANTI-VORTEX STABILIZER

The present invention relates to a centrifugal fan with improved efficiency and decreased noise.

In more detail, the invention relates to a centrifugal fan with a particular flow sharing device, which allows homogenization of the flow delivered and which, thanks to its form, makes it possible to reduce the vortices responsible for high noise and loss of efficiency of the aforesaid fan.

Functioning of a centrifugal fan is widely known and described in constructional details in treaties, publications and books which study in depth the incidence on its performance of the principal components of the fan, such as the inlet cone-impeller overlap, the use of a specific form of deflector and the various types of centrifugal impellers.

Also known are the problems relative to recirculations generated between impeller and inlet cone, inside the fan housing, and how these currents contribute towards both creating the phenomenon of rotating stall and incomplete filling of the blade ducts of the impellers. In fact, for example, experience has shown that the air passing through the fan does not always adhere to the form of the shroud, but detaches from this leaving the blades only partially filled.

It is also known that the airflow delivered from the fan depends on the form and accuracy of the components utilized to construct the fan (inlet cone, inlet cone-fan overlap, deflector, bearing support, form of the fan housing); in particular it must be noted that in centrifugal fans of the traditional type part of the flow thrust by the fan tends to follow the movement of the fan and recirculate, rather than being delivered through the delivery section.

Further, in order to produce a large delivery section, the sides of the fan housing are normally positioned at a certain distance from the shroud of the fan, so that the air tends to recirculate inside the fan housing, in particular around the inlet cone and the shroud.

Moreover, in the presence of relatively low traditional deflectors, part of the fluid tends to return to the fan housing through the delivery section in the zone next to the deflector.

It is known how these recirculations of air in the fan housing cause losses which reduce the performance and increase the noise of the fan.

Within the scope of the aforesaid requirements, the object of the present invention is to produce a centrifugal fan with improved efficiency and decreased noise, which obviates the problems mentioned above and, in particular, to indicate a centrifugal fan with improved efficiency and decreased noise which makes it possible to combat the onset of swirling which may derive from any source, in order to reduce total noise.

Another object of the present invention is to indicate a centrifugal fan with improved efficiency and decreased noise, which makes it possible to obtain a decrease in noise with a noteworthy diminishing of the tones prevalent at fundamental frequencies, making the frequency spectrum issued by the fan of the wide band type.

A further object of the present invention is to produce a centrifugal fan with improved efficiency and decreased noise, which makes it possible to diminish, stabilize and utilize the recirculations, vortices and stagnant flows, which affect noise, created by a high speed gradient between the walls of the fan housing, where the flow has minimum speeds, and the front disc of the impeller, where the speed of the air is close to the tangential speed of the impeller.

Yet another object of the present invention is suitable management of the separation and interaction of the aforesaid three flow rates, the return flow, the pulling flow and the flow caused by the speed gradient thus obtaining the effect of almost total elimination of the return flow.

Advantageously, therefore, the present invention makes it possible to obtain an even delivery flow similar to the flow that can be obtained using, for example, a duct, even relative short, placed at the outlet of a centrifugal fan, which, as is known, allows homogenization of the delivery flow.

In particular, the invention makes it possible to obtain stabilization of flow similar to the flow that can be obtained with said duct, even without using the duct.

In this regard, FIG. 1 shows a schematic view of the speed profiles at the discharge outlet of a centrifugal fan, in which 10 indicates the centrifugal fan in general, 11 the tapering element, commonly called deflector, of the casing or fan housing 12, inside which the air flows in the direction F, while 13 indicates the area through which the air flows at the tapering 11 of the fan housing 12, 14 the area of the delivery outlet and 15 the pipe fitted to the delivery outlet and used to homogenize the flow.

FIG. 1 also indicates the length L of the pipe 15 required to obtain a regular speed profile.

As can be seen clearly in the aforesaid FIG. 1, progressive stabilization of the flow takes place inside the pipe 15, moving away from the delivery outlet 14 of the fan 10, obtaining constant delivery conditions and improving noise and performance.

The same advantageous characteristics mentioned above may also be obtained using the device according to the present invention, without requiring to fit the duct illustrated at the outlet of the centrifugal fan, with further advantages from the viewpoint of overall dimensions and design and production costs of the duct.

A further characteristic of the invention is that it allows symmetrization of the delivery flow in the presence of a belt transmission or, generically, any system to transmit motor power.

In FIGS. 2A, 2B, 2C and 2D, the arrows D show the directions of flow in the delivery section of the centrifugal fan 10, in the presence of a transmission system 16, in the vicinity of the tapering element 17, when this is a common deflector (FIG. 2A, 2B) or when this is a flow separating element according to the invention (FIGS. 2C, 2D).

FIGS. 2A, 2B show the results in conditions of high and low flow rates, with common deflector, compared with the directions of flow obtained by applying the device of the present invention (FIGS. 2C, 2D), respectively relative to operation at high and low flow rate.

Finally, a further advantage of the invention is that it considerably reduces the natural tendency to stall during rotation, which normally occurs where there are very small deflectors.

These and other advantages are attained by a is centrifugal fan with improved efficiency and decreased noise, as claimed in claim 1, which should be referred to for brevity.

Further objects and advantages shall become more apparent from the description below, relative to a preferred although non-limiting example of the centrifugal fan with improved efficiency and decreased noise, the object of the invention, and from the attached drawings, in which:

FIG. 1 is a schematic view of the trend of the speed profiles and the formation of the regular speed profile of the air in a length of straight piping placed at the delivery outlet of a centrifugal fan, according to prior art;

FIGS. 2A–2B schematically show the directions of the air flow in the delivery section of the centrifugal fan, in the vicinity of a common deflector, without the use of the flow sharing device of the invention and in conditions of high and low flow rate, compared with the respective results obtained also after fitting said device (FIGS. 2C–2D);

FIG. 3 is a perspective, partly cutaway view of a centrifugal fan comprising a device or element to divide the flow of air delivered, produced in an exemplifying and preferred, although non-limiting, embodiment, according to the present invention;

FIGS. 4A–4C respectively show perspective views of alternative embodiments of a portion, produced in a single piece, of the device separating the flow delivered from the centrifugal fan, according to the present invention;

FIG. 5A is a perspective view of an embodiment alternative to those shown in FIGS. 4A–4C of the portion of the device, according to the invention;

FIG. 5B is a front view of the portion of the device according to the invention shown in FIG. 5A;

FIG. 5C is a side view of the portion of the device according to the invention shown in FIG. 5A;

FIG. 7A is a perspective view of an embodiment of a portion of the device according to the invention, alternative in relation to the one in FIG. 5A;

FIG. 7B is a front view of the portion of device, according to the invention, in FIG. 7A;

FIG. 7C is a side view of the portion of device, according to the invention, in FIG. 7A;

Figure 11B:
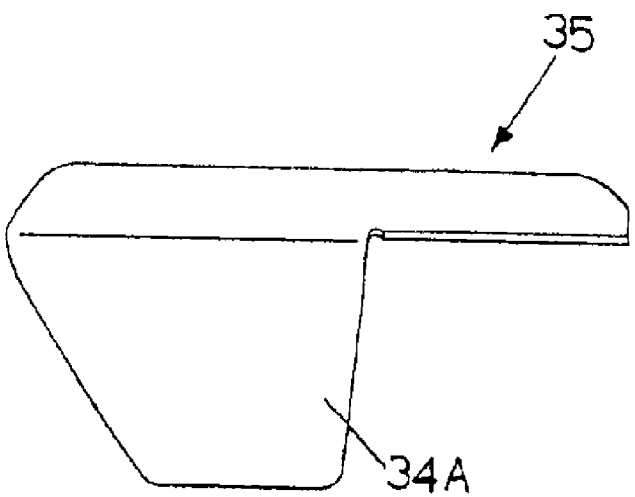
FIGS. 11A–11B show two front views relative to further embodiments of the portion of device shown in FIGS. 6 and 7A–7C, according to the invention.
Figure 11A:
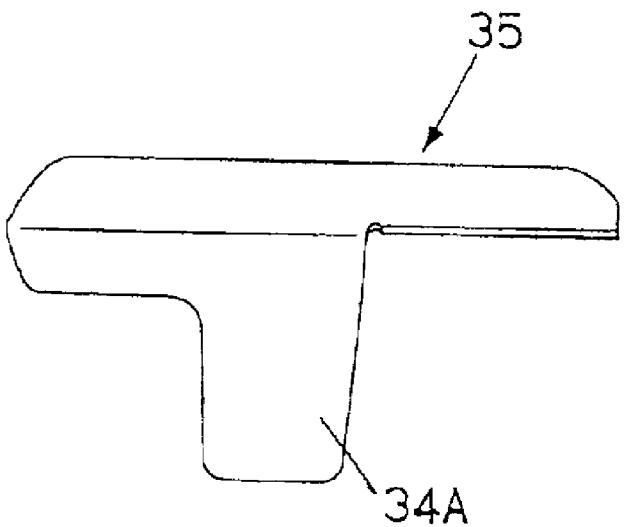
Figure 12B:
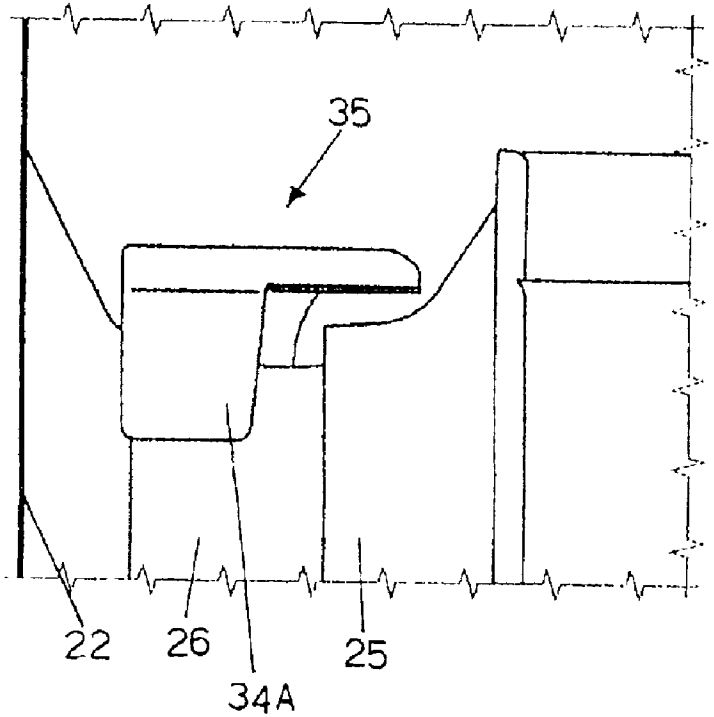
Figure 12A:
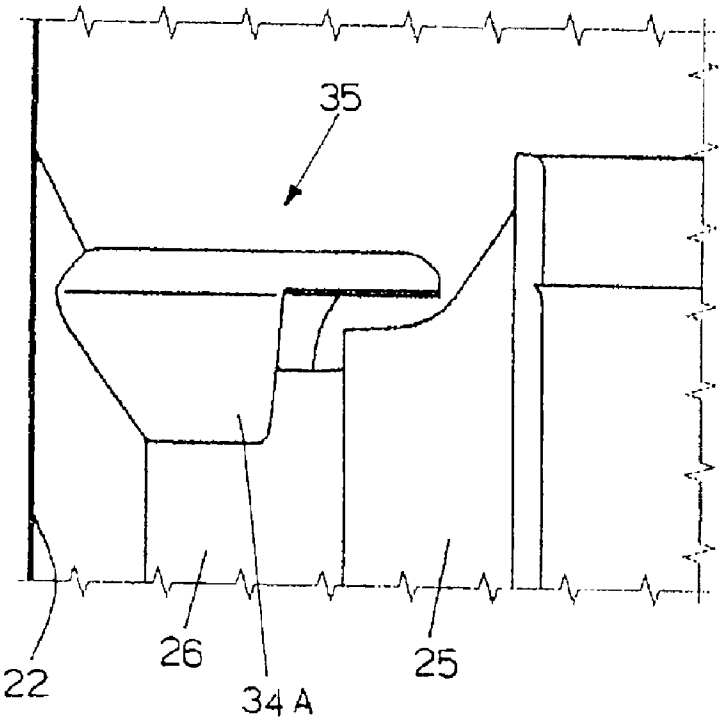

FIGS. 12A–12B relate to front views of respective portions of the centrifugal fan according to the present invention, fitted to which are the elements shown in FIGS. 11A–11B, according to an embodiment so as to adhere or not adhere to the inlet cone.

Prior to providing a detailed explanation of the characteristics of the centrifugal fan with high efficiency, according to the present invention, it must be understood that the application of this invention is not limited to the constructional details and the layout of the components illustrated in the attached drawings, as the flow sharing device responsible for decreasing noise and increasing efficiency of the fan may in practice be produced in various constructional embodiments.

Moreover, the invention may be applied to any form of fan housing and spiral, to any type of blade (airfoil, flat, backward curved, forward, radial, etc.), to fans with simple and double suction, with any form of inlet cone, front disc and overlapping or non overlapping zone between inlet cone and front disc.

Figure 2B:
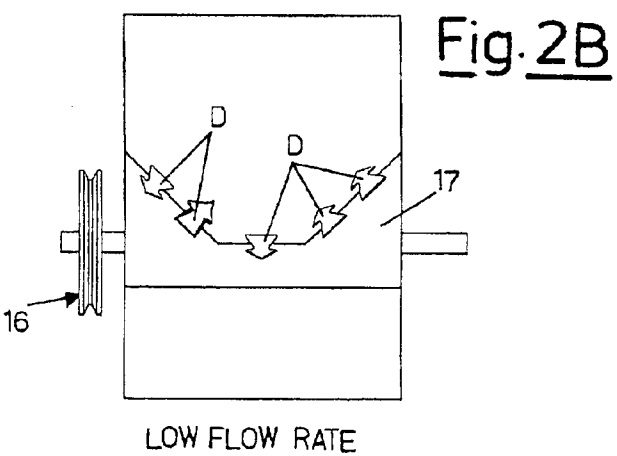
Figure 2A:
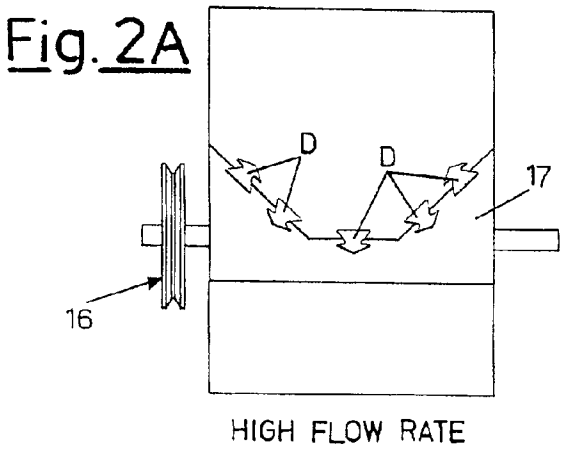
Figure 2D:
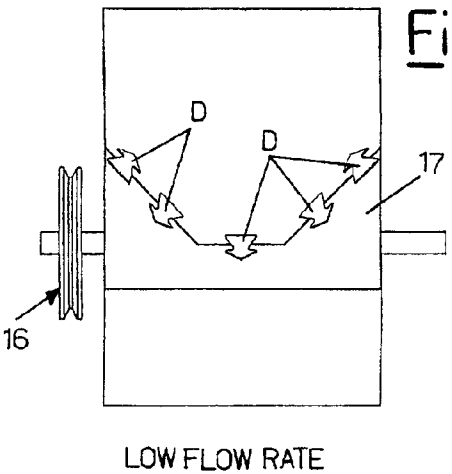
Figure 2C:
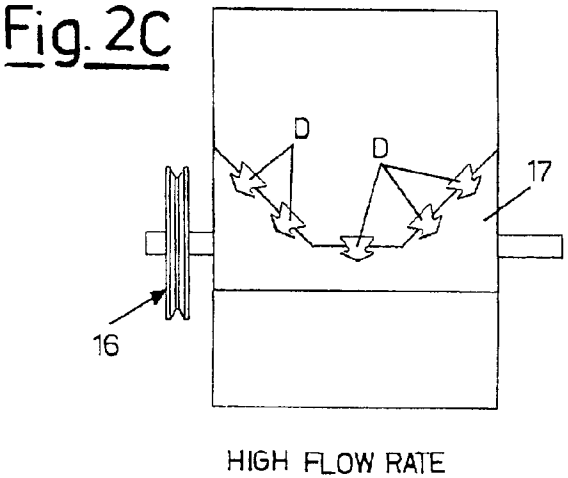
Figure 3:
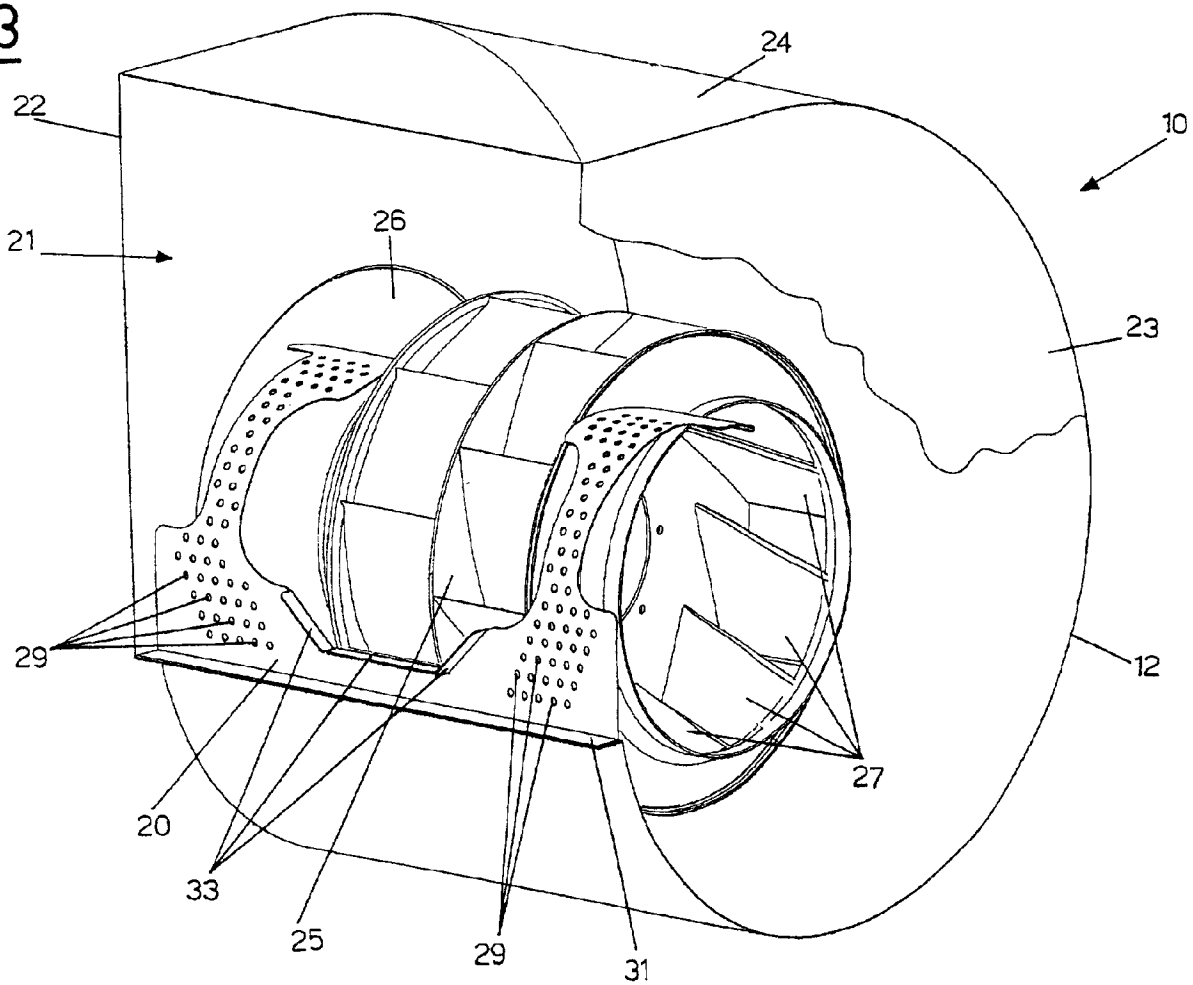

In particular, FIG. 3 of the assembly of the centrifugal fan, according to the present invention, shows an example of execution of a flow sharing device, indicated generically with 20, of the air flow delivered from the centrifugal fan 10.

The device 20 is produced, in the exemplifying although non-limiting case in FIG. 3, in a single piece, according to a particularly elaborate and relatively costly to produce embodiment, owing to the complex nature of the phenomena it regulates and optimizes; nonetheless, the fin 33 directing the air may or may not be present and this device may have any form and curvature radius and, consequently, the embodiment in FIG. 3 merely represents a non-limiting indicative example of the scope of protection of the present invention.

The device 20 is applied to the centrifugal fan 10, which consists of a fan housing 12, with parallel sides 22, 23, fixed to the opposite edges of the casing scroll 24 of the fan 10.

The fan housing 12 has a discharge opening 21 substantially rectangular or square and a fan 25, equipped with a series of blades 27 and positioned inside the fan housing 12 in the form of a volute, may or may not overlap the end of the inlet cone 26, which is riveted, bolted or welded to the side 22. It is possible to use as a fan 25 a conventional fan, which may have different forms according to the fluid and speed of the delivery air flow.

Figure 4C:
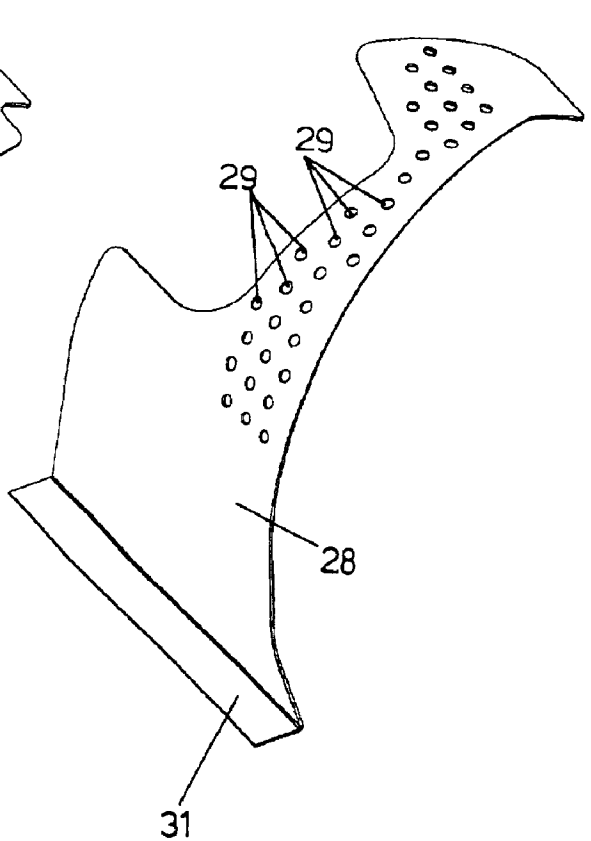
Figure 4B:
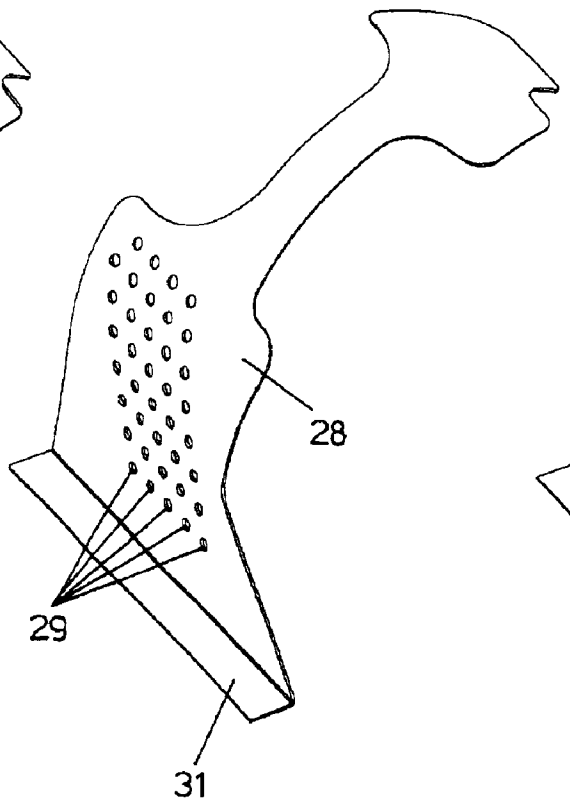
Figure 4A:
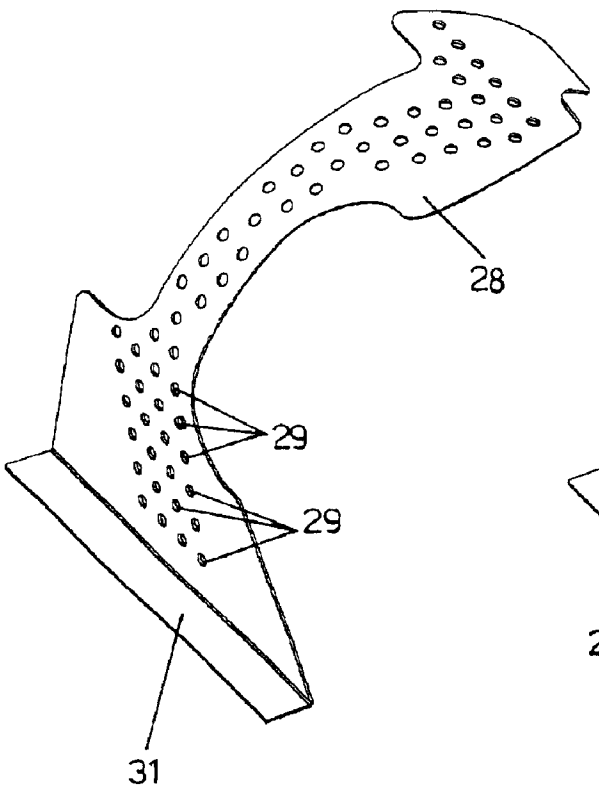

Alternatively to the constructional embodiment of FIG. 3, which shows the application of a flow sharing device 20, positioned along the entire width of the discharge opening 21 and produced in a single piece appropriately shaped for the purpose, the device 20 may be divided into two or more parts, of which FIGS. 4A–4C show some examples (with various shaped profiles 28 and if necessary with perforations 29 positioned appropriately in specific portions of the piece 28).

FIGS. 5A–5C show various views of a possible alternative embodiment of examples of FIGS. 4A–4C; in particular, FIG. 5C is an orthogonal view of the portion 28 of which the device 20 is composed, in which a possible curvature radius and a specific constructional form are highlighted.

Figure 6:
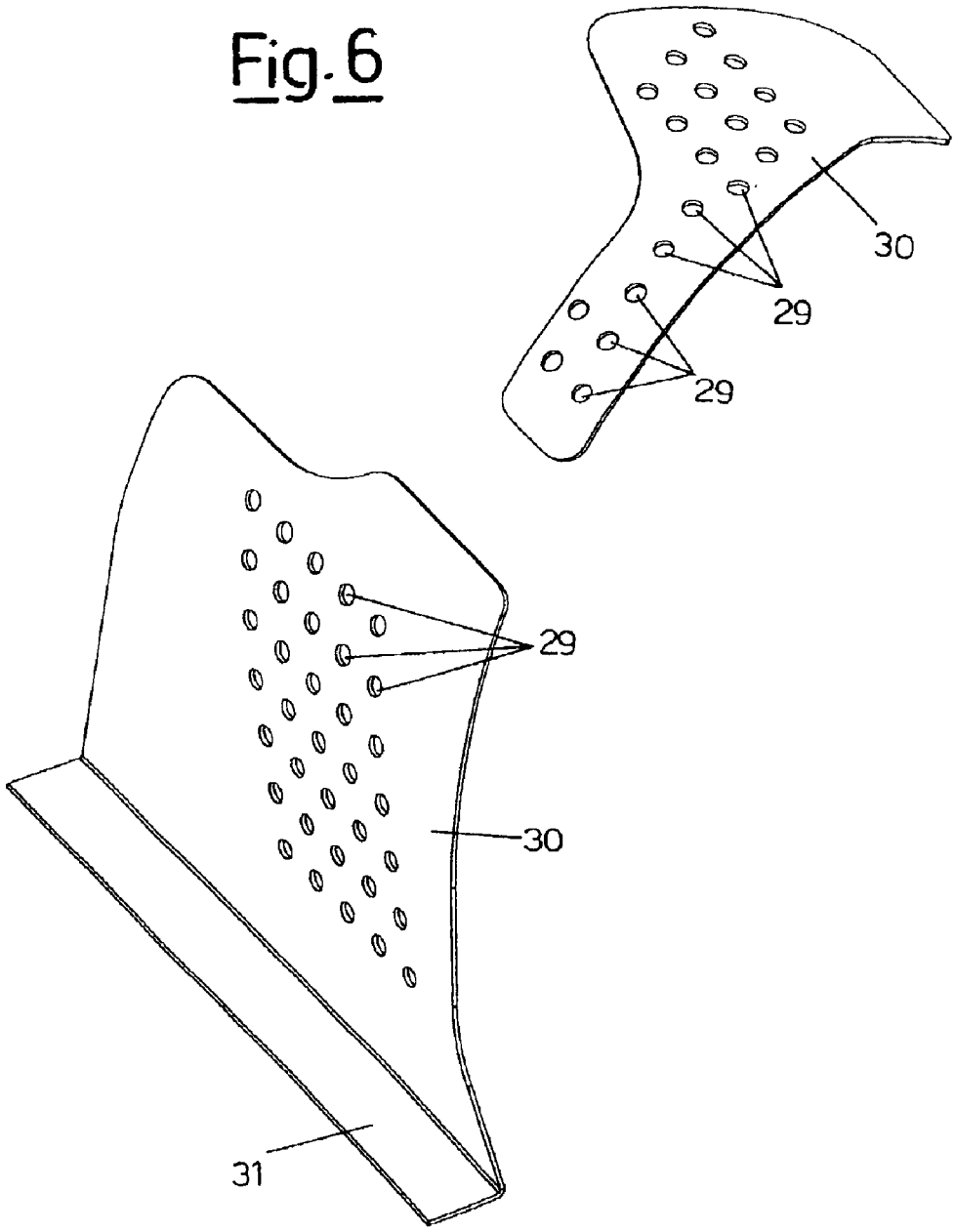
FIG. 6 is a perspective view of an alternative embodiment of the portion of the flow sharing device shown in FIGS. 4A–4C and 5A–5C, produced in two pieces.
Figures 8A, 8B, 8C, 8D, 8E, 8F, 8G, 8H, 8I, 8J, 8K, 8L, 8M, 8N, 8O:
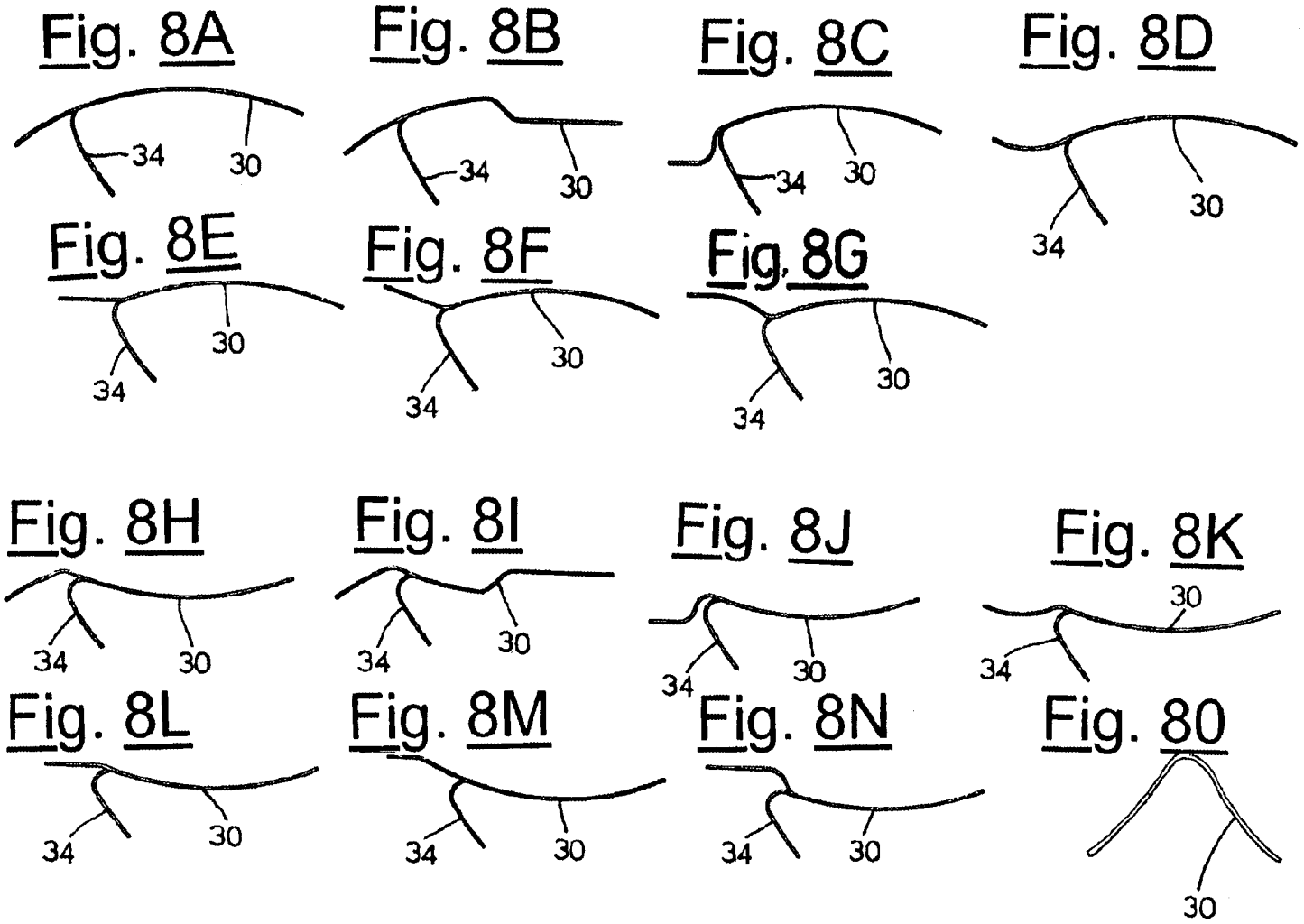
FIGS. 8A–8O show some of the possible alternative embodiments of the side profile of the portion of device shown in FIGS. 6 and 7A–7C, according to the invention.
Figures 9A, 9B, 9C, 9D, 9E, 9F, 9G, 9H, 9I, 10, 10A, 10B, 10C, 10D, 10E, 10F, 10G, 10H, 10I:
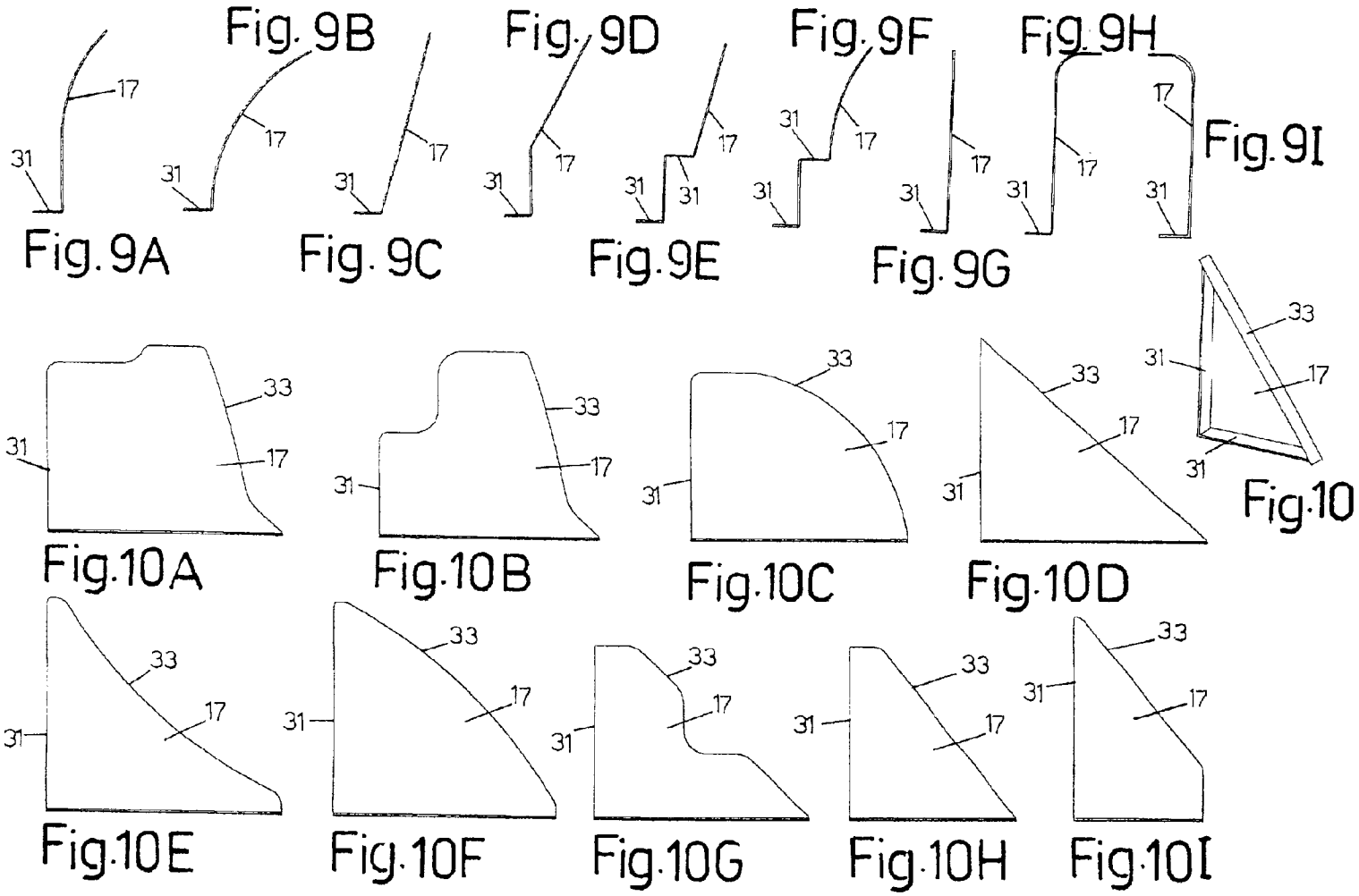
FIGS. 9A–9I show various alternative embodiments of deflectors applicable in combination to the device shown in FIGS. 6 and 7A–7C, according to the invention.
FIG. 10 shows a perspective view of one of the deflectors shown in FIGS. 9A–9I, in which the component 33 to guide the air may or may not be present.
FIGS. 10A–10I show some alternative embodiments of front views of the deflectors shown in FIGS. 9A–9I, according to the present invention.

To simplify the construction further, the device 20 according to the invention may be divided into two, three or more portions 30, equipped with perforations 29, as exemplified in FIG. 6; this figure shows one of the possible breakdowns of the component.

FIGS. 7A–7C, 8A–8O, 9A–9H and 10A–10I are views of some examples of embodiments of the device connected to the centrifugal fan according to the present invention, according to which the parts into which this device is split up are in any case necessary for the object of the invention.

It must also be noted that there is no predetermined relation between the views; a component produced according to one form may be shaped according to any one of the other profiles and without any limits.

The effect on total noise obtained by the device described may be considerably further improved if this device 20, in one or more pieces, is filled with noise insulating material (for example rock wool, foamed polyurethane, etc.) and if the position of the perforations 29 is arranged and concentrated in different zones of the device 20, according to the region on the aeraulic curve in which a reduction in noise is desired; in this manner an innovative mechanism capable of optimally separating the three flow rates mentioned above is obtained, reducing, controlling, stabilizing and utilizing the recirculations, vortices and stagnant flows created inside the fan housing 12.

In general, the device 20 may be arranged in any radial position along the spiral of the fan housing 12 and the circumference of the inlet cone 26 and may be produced in completely perforated sheet metal or in sheet metal with a specific percentage of holes, positioned in pre-established zones, if necessary with noise insulating material.

Moreover, the device 20 may be produced completely closed or open, according to whether or not there is an outlet on the part indicated with 34A in the detail FIGS. 11A–11B of a constructional portion of the device 20; this device must then be applied in combination with a deflector of any form (triangular, rectangular, trapezoidal, etc.), such as those shown as an example in FIGS. 9A–9H and 10A–10I.

The flow sharing device 20 may also have any form and curvature radius and may be positioned at the part adjacent to the fan housing 12 and the inlet cone 26, and may or may not be fixed to these; the device 20 may then be constructed to fully or partly overlap the front disc of the fan or impeller 25.

The geometrical layout of said device 20 may allow partial assembly of the structure which, in this case, may not be provided with the projecting parts 31, 32 of the portion 28 (in the case in which the device 20 has been produced in a single portion) or the projecting parts 31, 34 of the portions 30 (in the case in which the device 20 is composed of at least two portions 30). Moreover, with reference to FIGS. 5A–5C and 8A–8O, it must be noted that the portion 28 may also not be provided with the short appendage located beyond the intersection with the projecting part 32.

In the case shown in FIGS. 11A–11B and 12A–12B, there may be no element 34A of the portion of the device 20 indicated with 35 in these figures and destined to be fixed (welded, bolted, riveted, etc.) at the part adjacent to the fan housing 12 and the inlet cone 26.

In this situation, the flow sharing device 20 may overlap the front disc of the impeller 25 fully or partly or not overlap it at all and may be welded, bolted, riveted, etc. to the supporting structures mentioned above.

Finally, the device 20 may be produced in any material, although in the non-limiting exemplifying and preferred embodiments of the invention steel, light alloys (aluminium, copper, etc.), plastic materials and/or polyamide are normally used.

In particular, experimental measurements performed on industrial centrifugal fans have shown that optimum stabilization of the delivery air flow, with minimum noise and high efficiency, is obtained by producing a device 20 in four or five distinct pieces, two of which form a deflector with a triangular or generic profile and are positioned at the outlet of the fan 10 and the other two or more pieces, appropriately shaped, are fixed to a portion adjacent to the inlet cone 26.

From the description provided the characteristics of the centrifugal fan with improved efficiency and decreased noise, according to the present invention, are apparent, as are the advantages.

Finally, it is apparent that numerous variants may be made to the centrifugal fan with improved efficiency and decreased noise in question, without however departing from the principles of intrinsic novelty of the invention, as it is also apparent that, in the practical embodiment of the invention, the materials, forms and dimensions of the parts illustrated may be any according to requirements and these may be substituted with others technically equivalent.

What is claimed is:

1. Centrifugal fan (10) having improved efficiency and decreased noise, comprising at least one fan housing (12), with parallel sides (22, 23), which are fixed to opposite sides of at least one back (24), and at least one fan or impeller (25) with blades (27), positioned inside the fan housing (12), so that it does or does not overlap with the terminal of a mouth (26), characterized in that it establishes the use of, at a discharge opening (21) of the fan (10), arranged radially along the spiral of the fan housing (12) and the circumference of the mouth (26), a shaped stabilizer element (20), produced in a single piece (28) or more than one piece (30), with at least an appendage (30) facing the mouth (26), said shaped element (20) being suitable to allow separation of the flow rates and capable of determining homogenization of the flow at the outlet of the fan (10) and a decrease in vortices, responsible for high noise and loss of efficiency of the fan (10) wherein said shaped stabilizer element (20) has at least an appendage (30) fixed to said mouth (26).

2. Centrifugal fan (10) as claimed in claim 1, wherein said shaped stabilizer element (20) has at least an appendage (30) positioned at said mouth (26).

3. Centrifugal fan (10) as claimed in claim 1, wherein the appendage (30) may overlap the impeller (25).

4. Centrifugal fan (10) as claimed in claim 1, wherein said fan (10) has at least a system (16) for transmitting power to the motor and at least a deflector (17), positioned at the outlet (21).

5. Centrifugal fan (10) as claimed in claim 1, wherein said fan or impeller (25) is provided with a series of blades (27) and may or may not overlap the end of the mouth (26), which is riveted, bolted or welded to at least one of said sides (22, 23).

6. Centrifugal fan (10) as claimed in claim 1, wherein said shaped stabilizer element (20) has a series of perforations (29) arranged appropriately in specific portions of the element (20) or the pieces (28, 30) of which said element (20) is composed.

7. Centrifugal fan (10) as claimed in claim 1, wherein at least one portion (30) of the stabilizer element (20) may have a curvature radius and a specific form, so that it fully or partially overlaps the front disc of the fan (25).

8. Centrifugal fan (10) as claimed in claim 1, wherein said shaped element (20) is filled with noise insulating material, such as rock wool or foamed polyurethane.

9. Centrifugal fan (10) as claimed in claim 1, wherein said appendage (30) may have at least one portion (28, 30) with a projecting part (31, 32, 34).

10. Centrifugal fan (10) as claimed in claim 1, wherein said shaped stabilizer element (20) is composed of at least a first portion, forming a deflector of triangular or generic form, positioned at the outlet (21) of the fan (10) and of at least two second portions (35), appropriately shaped, fixed at parts adjacent to said mouth (26).

* * * * *